US005622106A

United States Patent [19]

Rayner

[11] Patent Number: 5,622,106

[45] Date of Patent: Apr. 22, 1997

[54] SELF-INKING EMBOSSING SYSTEM

[75] Inventor: Dignan H. Rayner, Clontarf, Australia

[73] Assignee: Hilglade Pty Ltd., Clontarf, Australia

[21] Appl. No.: 397,185

[22] PCT Filed: Sep. 9, 1993

[86] PCT No.: PCT/AU93/00464

§ 371 Date: Apr. 24, 1995

§ 102(e) Date: Apr. 24, 1995

[87] PCT Pub. No.: WO94/05501

PCT Pub. Date: Mar. 17, 1994

[30] Foreign Application Priority Data

Sep. 9, 1992 [AU] Australia ..... PL4593
May 19, 1993 [AU] Australia ..... PL8853

[51] Int. Cl.[6] ..... B31F 1/07

[52] U.S. Cl. ..... 101/32; 101/28; 101/DIG. 43; 283/72

[58] Field of Search ..... 101/3.1, 16, 28, 101/31, 31.1, 32, DIG. 43, 9, 12, 17, 21, 27, 29; 283/72

[56] References Cited

U.S. PATENT DOCUMENTS

| | | | |
|---|---|---|---|
| 1,727,520 | 9/1929 | Rist | 101/32 |
| 2,043,809 | 6/1936 | Papp | 101/27 |
| 2,071,031 | 2/1937 | Franz, Jr. | 101/32 |
| 2,320,925 | 6/1943 | Grant | 101/32 |
| 2,343,191 | 2/1944 | Kinlean | 101/28 |
| 2,842,884 | 7/1958 | Stevensen | 101/32 |
| 2,851,372 | 9/1958 | Kaplan et al. | 101/32 |
| 3,022,231 | 2/1962 | Broderick | 101/32 |
| 3,584,572 | 6/1971 | Apicella | 101/27 |
| 4,250,217 | 2/1981 | Greenaway | 101/32 |
| 4,646,634 | 3/1987 | Espe | 101/32 |
| 5,181,464 | 1/1993 | Kuhlman et al. | 101/28 |
| 5,199,744 | 4/1993 | Shewton | 101/32 |
| 5,356,364 | 10/1994 | Veith et al. | 101/32 |

FOREIGN PATENT DOCUMENTS

| | | | |
|---|---|---|---|
| 0318610 | 6/1989 | European Pat. Off. | 101/32 |
| 3041869 | 7/1982 | Germany . | |
| 3345886 | 6/1984 | Germany . | |
| 1528988 | 10/1978 | United Kingdom . | |

*Primary Examiner*—Eugene H. Eickholt
*Attorney, Agent, or Firm*—Larson and Taylor

[57] ABSTRACT

An embossing system for the simultaneous positive and negative (i.e. in and out embossing of an indicia (10) in sheet material (20) has a top plate (40) and a bottom plate (50) each with respective positive and negative embossing plate portions (43/53, 44/54) which are aligned and complementary, so arranged that during the embossing step, the neutral portions (45,55) of the plates (40,50) do not apply pressure to the sheet material (20). By applying ink to one plate (40), or by placing an ink ribbon (80) between the sheet material (20) and one plate (40), the indicia (10) can be simultaneously inked and embossed.

25 Claims, 3 Drawing Sheets

SELF-INKING EMBOSSING SYSTEM

BACKGROUND OF THE INVENTION

1. Field of the Invention

This invention relates to a self-inking embossing system. The invention also relates to an embossing system where the embossing extends above, and below, the material embossed.

2. Dictionary

Each plate has at least two zones. In at least one zone, the desired image is positively embossed into the paper in that zone. In the other zone(s), the desired image is negatively embossed out of the paper in that zone.

Each plate is made up with two forms of protuberances —(a) those that produce the desired image (ie. the signature, seal and/or associated security background(s); and (b) those that form the neutral portions of the plate which are only there to ensure that the desired image is made visible, or is expressed or embossed into or out of, the sheet material.

Throughout the description and claims, the following terms shall be given the broad definitions set out hereinafter:

(a) "sheet material" shall include paper, plasticised paper, fabric, card, cardboard, sheet plastics, metal foil, laminated sheets or the like;

(b) "positively embossed" means the desired image is embossed downwardly from (ie. below) the plane of the sheet material in that zone;

(c) "negatively embossed" means the desired image is embossed upwardly from (ie. above) the plane of the sheet material in that zone;

(d) "positive plate" or "positive plate portion" means the plate or plate portion has at least one ridge or protuberance to be impressed into the sheet material;

(e) "negative plate" or "negative plate portion" means the plate or plate portion has at least one recess or groove into which the sheet material is impressed; and (f) "indicia" includes letter(s); word(s); signature(s); logos; seals; drawings; graphics; or the like; and/or a combination of two or more of these.

3. Prior Art

There is an ever increasing need for improved security for financial and legal documents.

Large corporations can process millions of dollars daily and there is also the opportunity for unscrupulous persons to defraud the financial systems in place. Cheques or other negotiable documents can be stolen and forged signatures (or other authorities) applied thereto, or the whole documents can be forged.

Some corporations use signature machines to apply facsimile signatures to cheques, but these can be easily forged.

In some such machines, the signature(s) are printed and embossed onto the paper of the cheques. While the security against forging is improved, the quality of the signature(s) is poor.

For quality documents, eg. legal documents, registration certificates and bearer bonds, it is not possible to simultaneously ink and emboss the document and achieve a high quality result. In practice, the document is printed in one step and embossed in a second step, requiring considerable care to align the printing and embossing, eg. on a corporate seal.

SUMMARY OF THE INVENTION

It is an object of the present invention to provide an embossing system where respective portions of the desired image are positively and negatively embossed in the sheet material.

It is a preferred object to provide an embossing system where the indicia is simultaneously printed and embossed in the sheet material.

It is a further preferred object to provide an embossing system where the resultant embossing (and printing) provides a "mechanical fingerprint" in the sheet material which is extremely difficult, if not impossible, to forge.

It is a still further preferred object to provide an embossing system where the sheet material is provided with a computer identifiable (or recognisable) "fingerprint".

It is a still further preferred object to provide a system where the "fingerprint" can be scanned to detect forgery or tampering thereof.

Other preferred objects will become apparent from the following description.

In one aspect, the present invention resides in an embossing system to emboss at least one indicia into sheet material, including:

a first embossing plate; and a second embossing plate, wherein:

the first embossing plate incorporates at least one positive plate portion and at least one negative plate portion; and the second embossing plate incorporates a respective complementary negative plate portion and a respective complementary positive plate portion complementary thereto;

so arranged that at least one portion of the indicia is positively embossed in the sheet material and at least one other portion of the indicia is simultaneously negatively embossed in the sheet material.

The positively embossed portion of the indicia may surround, or be wholly or partly surrounded by, the negatively embossed portion of the indicia, or vice versa.

Ink may be applied to the positive plate portion of at least one of the plates to enable the indicia to be simultaneously inked onto, and embossed into, the sheet material. Alternatively, an ink ribbon may be interposed between one (or both) of the plates and the sheet material to enable the indicia to be simultaneously inked onto, and embossed into, the sheet material.

Preferably, the height of the ridge(s) or protuberance(s) on the positive plate portion(s) equals the depth of their complementary recess(es) or groove(s) in the negative plate portion(s).

Preferably, when the plates are brought together, the distance between the top of each ridge or protuberance and the bottom of its complementary recess or groove is greater than the thickness of the sheet material, or of the combined thickness of the sheet material and ink or ink ribbon. Preferably, the distance is in the range of 0.03–0.1 mm, more preferably 0.03–0.05 mm, greater than the thickness of the sheet material, or of the combined thickness of the sheet material and ink or ink ribbon.

Preferably, the width of the recess(es) or grooves exceeds the width of their complementary ridge(s) or protuberance(s).

Preferably, the difference in widths is just greater than twice the thickness of the sheet material, or twice the combined thickness of the sheet material and the ink ribbon, being preferably greater in the range of 0.08–0.18 mm, but not more than 0.4 mm.

Preferably, the distance between the side wall of a recess and the adjacent side wall of the complementary ridge or protuberance exceeds the thickness of the sheet material, or the combined thickness of the sheet material and the ink ribbon, by not more than 0.2 mm (more preferably 0.09 mm), most preferably in the range of 0.04–0.075 mm.

Preferably, each plate is formed with a photosensitive polymer or nylon film layer bonded to a plastics or metal backing plate (mountable in an embossing machine). The ridge(s), protuberance(s), recess(es) or groove(s) are formed in the film layer of each plate.

Preferably, the positively embossed portion(s) of the indicia appear on the sheet material as substantially solid lines.

Preferably, the negatively embossed portion(s) of the indicia appear on the sheet material as lines bordering the (raised) portions of the desired image.

Preferably, the neutral portions of the plates (intermediate the ridge or protuberances and the recesses or grooves) are maintained in spaced relationship as the sheet material is embossed to prevent inking in the neutral portions.

Preferably, on the plates the side walls of the ridges or protuberances and recesses or grooves are perpendicular to the neutral portions, but the walls may be inclined thereto.

In a second aspect, the present invention resides in a method of embossing an indicia in sheet material employing the embossing system hereinbefore described, the method including the steps of:

(a) placing the sheet material between the first and second plates;

(b) relatively advancing the first and second plates until the respective positive and negative plate portions of the first plate are in aligned, overlapping engagement with the complementary negative and positive plate portions of the second plate to cause the indicia to be simultaneously positively and negatively embossed in the sheet material; and (c) separating the plates to enable the removal of the embossed sheet material.

To enable the simultaneous printing and embossing, ink may be applied to the positive plate portion(s) of at least one of the plates before step (a). Alternatively, an ink ribbon may be interposed between the sheet material and the plate or plates before the plates are brought together in step (a).

BRIEF DESCRIPTION OF THE DRAWINGS

To enable the invention to be fully understood, preferred embodiments will now be described with reference to the accompanying drawings, in which:

FIG. 1 is a plan view of an indicia embossed in, and printed on, a sheet of paper or the like;

FIG. 5 is a sectional view, on an enlarged scale, showing the simultaneous inking and embossing of a sheet of paper or the like;

FIG. 7 is a sectional side view of an alternative embodiment for simultaneously inking and embossing a sheet of paper or the like.

DETAILED DESCRIPTION OF PREFERRED EMBODIMENTS

Figure 1:
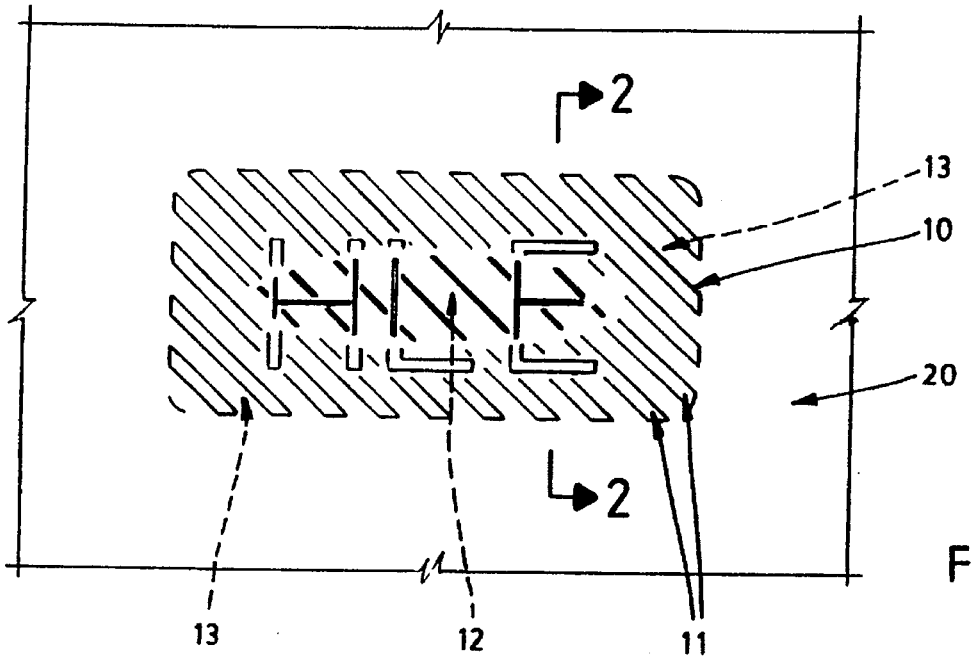

Referring to FIG. 1, the indicia 10, comprising the letters "HLE" on a background of diagonal lines/stripes 11, is embossed and printed on a sheet of paper 20 or like material.

Figure 2:
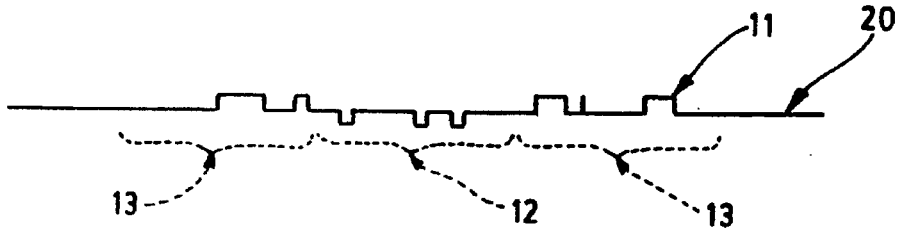
FIG. 2 is a section view taken on line 2—2 on FIG. 1.

The central zone 12 of the indicia 10, where the indicia appears as substantially solid lines, or fine border lines, is embossed positively, ie. downwardly below the plane of the paper – see FIG. 2. The border zone 13 of the indicia 10, around the central zone 12, is embossed negatively, ie. above the plane of the paper 20, and the indicia appears as border lines around the raised portions of the desired image in the paper sheet 20.

Figure 3:
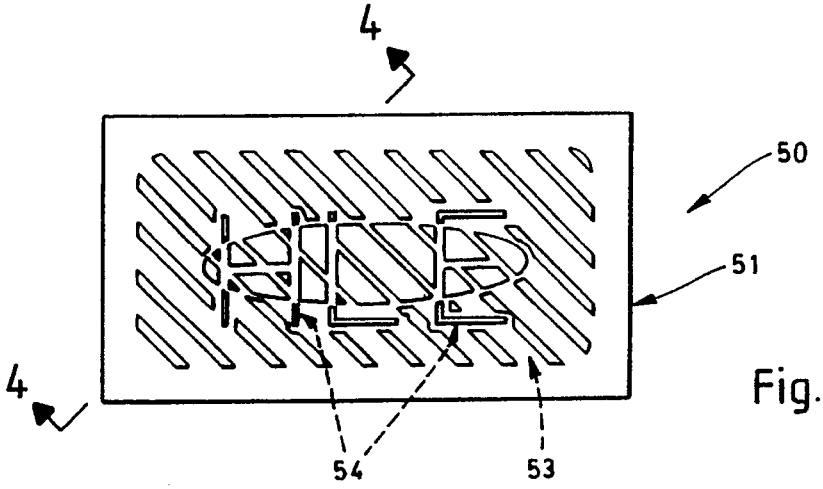
FIG. 3 is a plan view of the bottom plate for embossing the indicia of FIG. 1 (shown in reverse or mirror for easier understanding)
Figure 4:
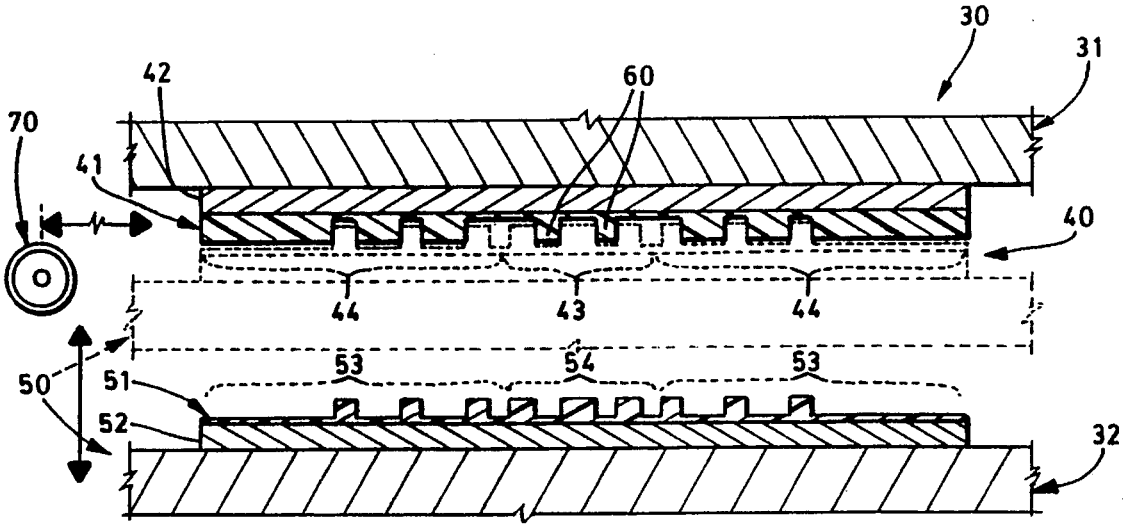
FIG. 4 is a sectional view, on line 4—4 on FIG. 3, of the bottom plate and of the complementary top plate.

Referring to FIGS. 3 and 4, the indicia 10 is embossed using a pair of complementary embossing plates in an embossing machine 30 which has a fixed upper platen 31 and movable lower platen 32.

Both the top plate 40 and bottom plate 50 have a layer of photosensitive polymer 41, 51 on a metal backing plate 42, 52 mountable on a respective platen 31, 32 (or roller) in the embossing machine 30.

Each plate 40, 50 has a respective positive plate portion 43, 53 and an aligned, complementary negative plate portion 44, 54. The height of the ridges or protrusions 60 in the positive plate portions 43, 53 is substantially equal to the depth of the recess or groove 61 in the negative plate portions 44, 54, but the platens 31, 32 control the relative movement of the plates 40, 50 so that the distance between the top of a ridge or protuberance 60 and the bottom of its aligned, complementary recess or groove 61 is not less than the thickness of the paper sheet 20 being embossed. Each recess or groove 61 has a width which exceeds the width of its aligned ridge or protuberance by not less than twice the thickness of the paper sheet 20 plus the inking ribbon 80.

When the bottom plate 50 is advanced, as shown in dashed lines in FIG. 4, the indicia 10 is simultaneously positively and negatively embossed in the paper sheet 20 in the respective zones 12, 13.

To enable the indicia 10 to be simultaneously inked and embossed in the paper sheet 20, dripless ink may be applied to the ridges or protuberances 60 of the positive plate portion 43 of the top plate 40 by an inking roller 70 before the paper sheet is placed between the plates 40, 50. As the plates 40, 50 are brought together so that the distance between their neutral portions is not less than the thickness of the paper sheet 20, only the positively embossed zone 12 of the indicia will be inked.

In an alternative embodiment (see FIG. 5) for the simultaneous inking and embossing of the paper sheet 20, an ink ribbon 80 (which may have one or more coloured inks (eg. red/green/blue) on a carrier) is laid on the paper sheet 20 before it is embossed, or the ribbon 80 may be fed past the top plate 40 by a suitable feed and guide system (not shown) in the embossing machine 30.

Figure 5:
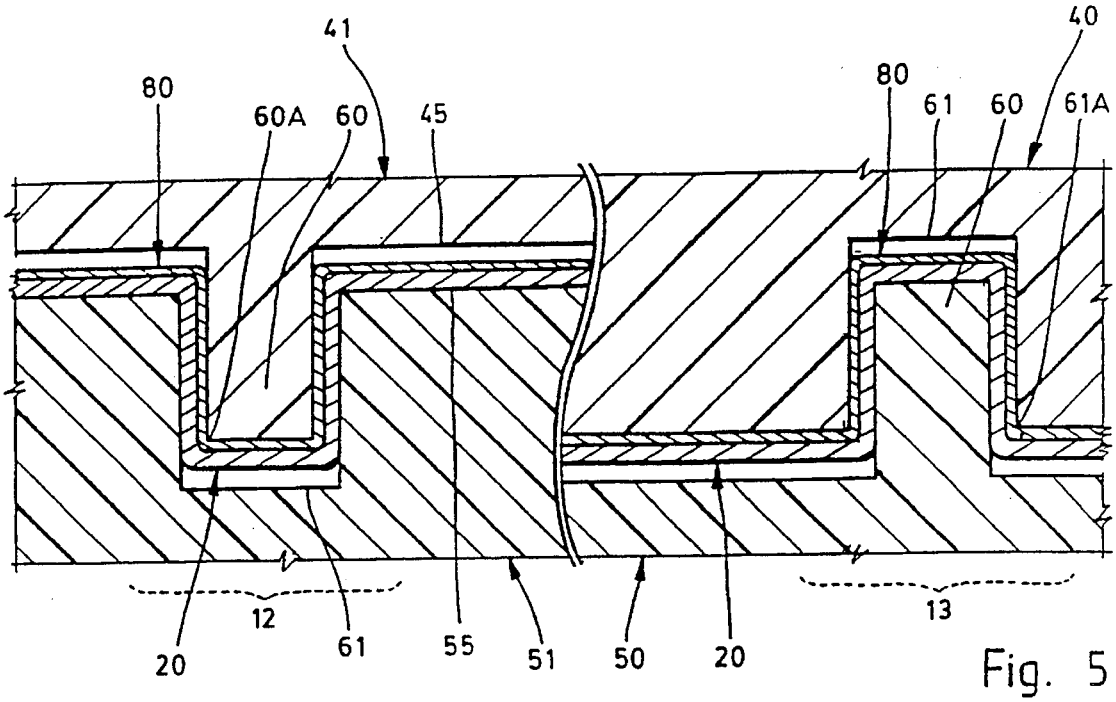
Figure 6:
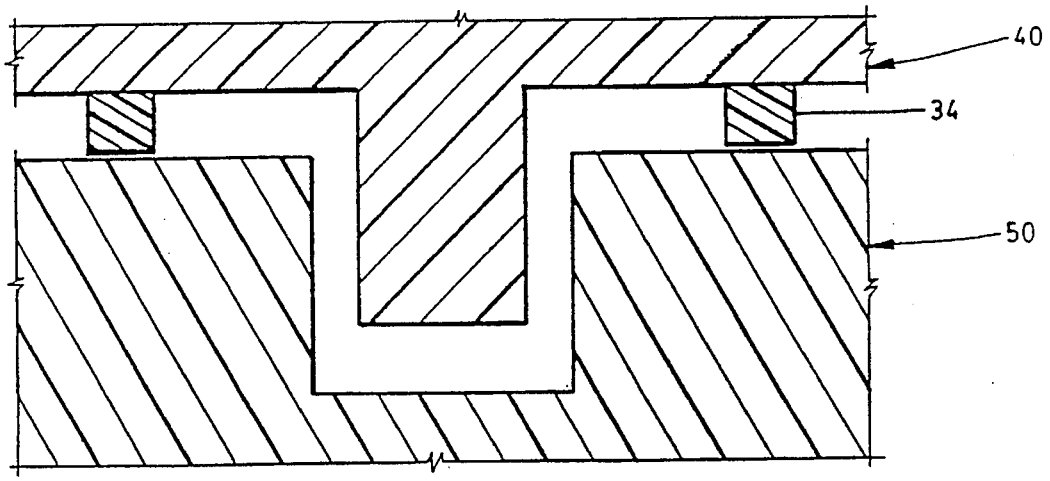
FIG. 6 is a sectional side view of an alternative embodiment for spacing the plate.

As shown in FIG. 5, the height of the ridges 60 and the depth of the recesses 61 are equal, but the travel of the bottom plate 50 is controlled so that the neutral portions 45, 55 do not press on the ink ribbon 80 and paper sheet 20, so no inking occurs in these areas. (As shown in FIG. 6, the travel can be controlled by stops 34 between the plates 40, 50.)

The relative travel of the plates 40, 50 is preferably controlled by the braking action of the paper sheet 20 as it is embossed.

The width of each recess 61 exceeds the width of its respective ridge 60 by an amount less than 0.4 mm greater than twice the combined thickness of the paper sheet 20 and ink ribbon 80, ie. the distance between a side wall of the recess 61 and the adjacent side wall of the ridge 60 does not exceed the combined thickness of the paper sheet 20 and ink ribbon 80 by more than 0.2 mm (more preferably 0.15 mm).

In the area of positive embossing 12 (see left side of FIG. 5), when the ridge 60 enters the recess 61, the paper sheet 20 over the recess 61 is stretched (but the surrounding areas are unaffected). The pressure applied between the side walls of the ridge 60 and recess 61 cause fine border lines to be inked, with minimal inking therebetween as the top of the ridge 60 and the bottom of the recess do not press the paper sheet 20 or ink ribbon 80. The sharp corners 60A of the ridge 60 ensure good definition in the inking step.

In the area of negative embossing 13 (see the right hand side of FIG. 5), the paper sheet 20 is inked on the outerside faces of this raised embossing to form "shadow" or border lines therearound, the paper sheet being stretched about the corners 61A of the recesses 60 in the negative plate portions 44, 54.

The friction between the paper sheet 20 and ink ribbon 80, and the plates 40, 50 controls the relative travel of the plates 40, 50 so that the neutral portions 45, 55 thereof do not come into contact. By varying the width of the recesses 61 to the width of the respective ridges 60, the braking force can be selectively varied to control the relative travel of the plates 40, 50 as the embossing and inking step is effected. The braking effect must operate before the plates come into contact. If the paper is too light, the plates will come into full contact and the whole area will be inked. (Increasing the paper thickness, eg. from 75 gsm to 80 gsm will increase the braking force and reduce the relative travel of the ridges 60 into the recesses 61.) The greater the inherent strength of the paper, the greater the tendency for it to be pushed against the walls of the recesses and hence increase the braking force.

The operation of the plates 40, 50 is determined on a trial and error basis on the paper to be embossed, and the depth of the embossing for a set weight (ie. GSM) of paper determined by varying the pressure applied to the plates and the relative distances between the side walls of the ridges and recesses. If the pressure applied to the plate is increased, the embossing depth is increased. Generally, each embossing machine has controls to enable the pressure to be regulated.

Figure 7:
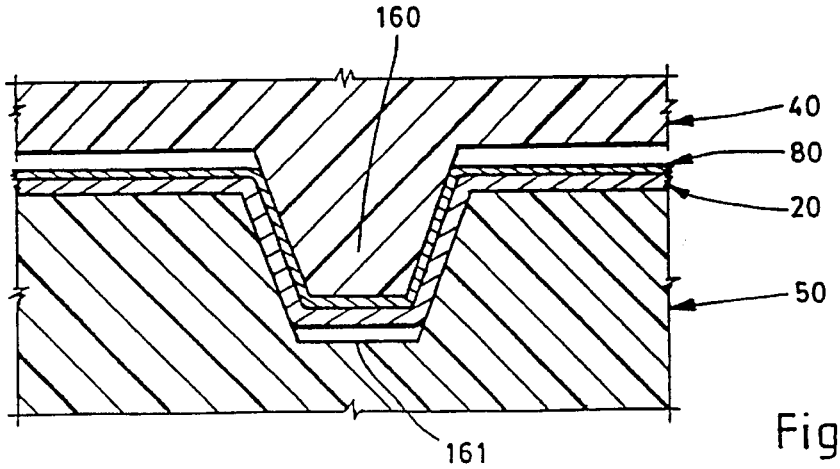

As shown in FIG. 7, the relative travel of the plates 40, 50 can be controlled by the provision of inclined walls on the ridges 160 and the recesses 161 which generate a wedging action between the plates.

The system is applicable to the simultaneously positive and negative embossing, and simultaneous inking of indicia in or on sheet material including:

(a) paper;

(b) plasticised paper;

(c) fabric;

(d) card;

(e) cardboard;

(f) sheet plastic;

(g) metal foil; or (h) a laminate or 2 or more of the above.

Potential applications include:

(a) printing signatures or sheaves, letters of credit, bearer bonds or other negotiable financial documents;

(b) printing share certificates;

(c) applying corporate or legal seals or documents where, eg. the potential for forging is high and/or where computer recognition (by scanning) is desired.

With the simultaneous positive and negative embossing, and inking, of the indicia, the potential for forging is effectively eliminated.

The ridges or protuberances, and the recesses or grooves, must be accurately formed on the plates 40, 50 and the plates 40, 50 must be accurately aligned in use, to produce the desired results.

The embossing of the sheet material 10 by the plates 40, 50 generates a mechanical fingerprint which is individual because the plates 40, 50 are hand-made and the tolerances are so fine that, when the plates are being made, any slight variations that invariably arise when making an individual object in a pressure situation (ie. a time critical environment) visually appear as differences in the plates.

Thus, if plates for a signature or seal are made using the same process twice, two different sets of plates will result. The plates 40, 50 are made out of photosensitive polymer and are hand washed under critical time conditions to produce the required result. The critical time conditions are applicable because if the plates are not finished within a very short critical time phase, the plate profiles fall off. (Because the braking process is used to stop the plates 40, 50, any infinitesimally small differences in the walls of the recesses or ridges appear as visible appearances on the indicia —appearing in the signature as differences in the amount of pressure and ink applied to the paper. Thus, the operator is operating at such a critical speed that it is impossible to counterfeit the exact plate tolerances of the originals which are in the order of hundredths of a millimeter.

The resulting three-dimensional mechanical fingerprint embossed in the sheet material 20 can be scanned into a computer by scanning equipment and can be read and identified by using systems similar to those already developed in the United States of America for cross checking human fingerprints. In this case, however, the fingerprint can be read simultaneously on the front and the rear of the paper 20. The rear fingerprint is created by passing it over firm ink rollers or a similar device, which will then put ink only on the raised portion of the paper (in the same way a human fingerprint is obtained from the raised portions in the skin on the finger). The two scanned images, front and rear, will then have to correlate exactly for the signal to be given that it is correct.

This fingerprint can then be scanned by the fingerprint scanning processors to produce a double sided fingerprint, or two different fingerprints of the same signature and seal, on different sides of the paper that must be aligned and correlate exactly to give a positive identification. The process will greatly enhance the cheque processing abilities of the banks and provide a major asset to the banks in producing a high speed, extremely accurate, signature recognition system. It is extremely accurate and very difficult to copy because it is two sided —each of which is different —and both sides have to be aligned exactly to give a positive identification.

It will be readily apparent to the skilled addressee that the present invention provides a high quality, secure embossing and inking system.

Various changes and modifications may be made to the embodiments described and illustrated without departing from the present invention.

I claim:

1. Apparatus for embossing at least one indicia into sheet material, comprising:

a first embossing plate having at least one positive plate portion and at least one negative plate portion; and a second embossing plate having a respective complementary negative plate portion and a respective complementary positive plate portion;

each positive plate portion having at least one ridge or protuberance;

each negative plate portion having a complementary recess or groove for each ridge or protuberance;

the height of each ridge or protuberance being equal to the depth of its complementary recess or groove;

said first and second plates being arranged such that, in use of the apparatus, when the plates are brought together, the distance between the top of a ridge or protuberance and the bottom of its complementary recess or groove is in range of 0.03–0.1 mm greater than the thickness of the sheet material, or of the combined thickness of the sheet material and any ink applied to a positive plate portion or of the combined thickness of the sheet material and any ink ribbon interposed between one or both of the plates and the sheet material, and such that at least one portion of the indicia is positively embossed in the sheet material and at least one other portion of the indicia is simultaneously negatively embossed in the sheet material.

2. Apparatus for embossing at least one indicia into sheet material, comprising:

a first embossing plate having at least one positive plate portion and at least one negative plate portion; and a second embossing plate having a respective complementary negative plate portion and a respective complementary positive plate portion;

each positive plate portion having at least one ridge or protuberance;

each negative plate portion having a complementary recess or groove for each ridge or protuberance;

the height of each ridge or protuberance being equal to the depth of its complementary recess or groove;

said first and second plates being arranged such that, in use of the apparatus, when the plates are brought together, the width of each recess or groove exceeds the width of its complementary ridge or protuberance, the difference in widths being just greater than twice the thickness of the sheet material, or twice the combined thickness of the sheet material and any ink ribbon interposed between one or both of the plates and the sheet material, and such that at least one portion of the indicia is positively embossed in the sheet material and at least one other portion of the indicia is simultaneously negatively embossed in the sheet material.

3. Apparatus as claimed in claim 1 or claim 2, wherein:

the positively embossed portion of the indicia surrounds, or is wholly or partly surrounded by, the negatively embossed portion of the indicia, or vice versa.

4. Apparatus as claimed in claim 1 or claim 2 further comprising means for applying ink to the positive plate portion of at least one of the plates to enable the indicia to be simultaneously inked onto, and embossed into, the sheet material.

5. Apparatus as claimed in claim 1 or claim 2 further comprising an ink ribbon interposed between one or both of the plates and the sheet material to enable the indicia to be simultaneously inked into, and embossed into, the sheet material.

6. Apparatus as claimed in claim 1 wherein said range is 0.03–0.05 mm.

7. Apparatus as claimed in claim 2 wherein:

the difference in widths does not exceed 0.4 mm, so that the distance between a side wall of a recess and an adjacent side wall of a complementary ridge or protuberance exceeds the thickness of the sheet material, or the combined thickness of the sheet material and ink ribbon, by not more than an amount of 0.2 mm.

8. Apparatus as claimed in claim 1 or claim 2 wherein:

each plate is formed with a photosensitive polymer film layer bonded to a plastics of metal backing plate or roller mountable in an embossing machine; and wherein each ridge, protuberance, recess and groove is formed in the film layer of each plate.

9. Apparatus as claimed in claim 1 or claim 2 wherein:

walls of the ridges or protuberances, and the recesses or grooves, are perpendicular to neutral portions of the plates intermediate the ridges or protuberances and intermediate the recesses or grooves.

10. Apparatus as claimed in claim 2 wherein said amount is 0.09 mm.

11. Apparatus as claimed in claim 2 wherein said amount is in the range of 0.04–0.075.

12. Apparatus according to claim 1 wherein, when the plates are brought together in use of the apparatus, the width of the recess or groove exceeds the width of its complementary ridge or protrudance.

13. Apparatus according to claim 12, wherein the difference in width is just greater than twice the thickness of the sheet material, or twice the combined thickness of the sheet material and any ink ribbon interposed between one or both of the plates and the sheet material.

14. Apparatus according to claim 13, wherein the difference in width does not exceed 0.4 mm, so that the distance between a side wall of a recess and an adjacent side wall of a complementary ridge or protuberance exceeds the thickness of the sheet material, or the combined thickness of the sheet material and ink ribbon, by not more than an amount of 0.2 mm.

15. Apparatus according to claim 8 wherein each plate is formed with a hand washed photosensitive polymer film layer.

16. A method of embossing an indicia in sheet material comprising:

(a) providing embossing apparatus comprising:

a first embossing plate having at least one positive plate portion and at least one negative plate portion; and a second embossing plate having a respective complementary negative plate portion and a respective complementary positive plate portion;

each positive plate portion having at least one ridge or protuberance;

each negative plate portion having a complementary recess or groove for each ridge or protuberance;

the height of each ridge or protuberance being equal to the depth of its complementary recess or groove;

said first and second plates being arranged such that, in use of the apparatus, when the plates are brought together, the distance between the top of a ridge or protuberance and the bottom of its complementary recess or groove is in the range of 0.03–0.1 mm greater than the thickness of the sheet material, or of the combined thickness of the sheet material and any ink applied to a positive plate portion or of the combined thickness of the sheet material and any ink ribbon interposed between one or both of the plates and the sheet material, and such that at least one portion of the indicia is positively embossed in sheet material and at least one other portion of the indicia is simultaneously negatively embossed in the sheet material;

(b) placing sheet material between the first and second plates;

(c) relatively advancing the first and second plates until the respective positive and negative plate portions of the first plate are in aligned, overlapping engagement with the complementary negative and positive plate portions of the second plate to cause the indicia to be simultaneously positively and negatively embossed in the sheet material; and (d) separating the plates to enable the removal of the embossed sheet material.

17. A method of embossing an indicia in sheet material comprising:

(a) providing embossing apparatus comprising:

a first embossing plate having at least one positive plate portion and at least one negative plate portion; and a second embossing plate having a respective complementary negative plate portion and a respective complementary positive plate portion;

each positive plate portion having at least one ridge or protuberance;

each negative plate portion having a complementary recess or groove for each ridge or protuberance;

the height of each ridge or protuberance being equal to the depth of its complementary recess or groove;

said first and second plates being arranged such that, in use of the apparatus, when the plates are brought together, the width of each recess or groove exceeds the width of its complementary ridge or protuberance, the difference in widths being just greater than twice the thickness of the sheet material, or twice the combined thickness of the sheet material and any ink ribbon interposed between one or both of the plates and the sheet material, and such that at least one portion of the indicia is positively embossed in the sheet material and at least one other portion of the indicia is simultaneously negatively embossed in the sheet material;

(b) placing sheet material between the first and second plates;

(c) relatively advancing the first and second plates until the respective positive and negative plate portions of the first plate are in aligned, overlapping engagement with the complementary negative and positive plate portions of the second plate to cause the indicia to be simultaneously positively and negatively embossed in the sheet material; and (d) separating the plates to enable the removal of the embossed sheet material.

18. A method as claimed in claim 16 or claim 17 wherein:

at least one positively embossed portion of the indicia appear on the sheet material as substantially solid lines; and at least one negatively embossed portion of the indicia appear on the sheet material as shadow lines bordering raised portions of the indicia.

19. A method as claimed in claim 16 or claim 17 wherein:

neutral portions of the plates intermediate the ridges or protuberances and intermediate the recesses or grooves are maintained in spaced relationship as the sheet material is embossed to prevent inking in the neutral portions.

20. A method as claimed in claim 16 or 17 wherein:

to enable simultaneous inking and embossing, ink is applied to each positive plate portion of at least one of the plates before step.

21. A method as claimed in claim 16 or 17 wherein:

an ink ribbon is interposed between the sheet material and the plate or plates before the plates are brought together in step (b).

22. Sheet material embossed by the method of claim 16.

23. Sheet material embossed by the method of claim 17.

24. A method according to claim 16 or claim 17 wherein ink is applied on a reverse side of the sheet material to tops of the indicia positively embossed in the sheet material to enable simultaneous scanning and comparison of both front and rear sides of the sheet material.

25. Sheet material embossed by the method of claim 24.

* * * * *